United States Patent [19]

Nishikawa

[11] 4,269,503

[45] May 26, 1981

[54] TONER CLEANING APPARATUS

[75] Inventor: Masaji Nishikawa, Hachioji, Japan

[73] Assignee: Olympus Optical Co., Ltd., Tokyo, Japan

[21] Appl. No.: 55,292

[22] Filed: Jul. 5, 1979

[30] Foreign Application Priority Data

Jul. 12, 1978 [JP] Japan ..... 53/84058

[51] Int. Cl.[3] ..... G03G 21/00

[52] U.S. Cl. ..... 355/15; 15/256.52; 355/3 R

[58] Field of Search ..... 355/3 R, 15; 15/256.51, 15/256.52

[56] References Cited

U.S. PATENT DOCUMENTS

| | | | |
|---|---|---|---|
| 3,508,823 | 4/1970 | Gundlach et al. | 355/3 R |
| 3,741,157 | 6/1973 | Krause | 355/15 X |
| 3,819,263 | 6/1974 | Draugelis et al. | 355/15 X |
| 3,914,045 | 10/1975 | Namiki et al. | 355/15 |
| 4,006,987 | 2/1977 | Tomono et al. | 15/256.52 X |
| 4,087,170 | 5/1978 | Sawaoka et al. | 355/15 X |
| 4,142,165 | 2/1979 | Miyakawa et al. | 355/15 X |
| 4,145,137 | 3/1979 | Sunaga et al. | 15/256.51 X |
| 4,185,910 | 1/1980 | Nomura et al. | 355/15 |

*Primary Examiner*—Fred L. Braun

*Attorney, Agent, or Firm*—Haseltine and Lake

[57] ABSTRACT

A toner cleaning apparatus for use in an electrophotographic apparatus having a rotatable photosensitive drum, a corona charger for uniformly charging or electrifying the photosensitive drum, an optical system for projecting an image of a document to be duplicated to form an electrostatic latent image, a biased magnet roller type developing device for developing the latent image with a dry toner to form a toned image, a rotatable transfer roller for transferring the toner image onto a record paper which is synchronously fed between the drum and the roller, and a fixing device for fixing the toner image onto the record paper. A first exclusive cleaning device such as brush type and blade type cleaners are arranged between the transfer roller and the corona charger and a switching device for changing a bias voltage applied to the developing device cooperates therewith such that the developing device is selectively operated as a developing device and a second cleaning device. A control device selectively operates the first and second cleaning devices in such a manner that the second cleaning device is usually operative, while the first exclusive cleaning device is operative only when the developing device could not be used or is not suitable to be used as the second cleaning device.

11 Claims, 10 Drawing Figures

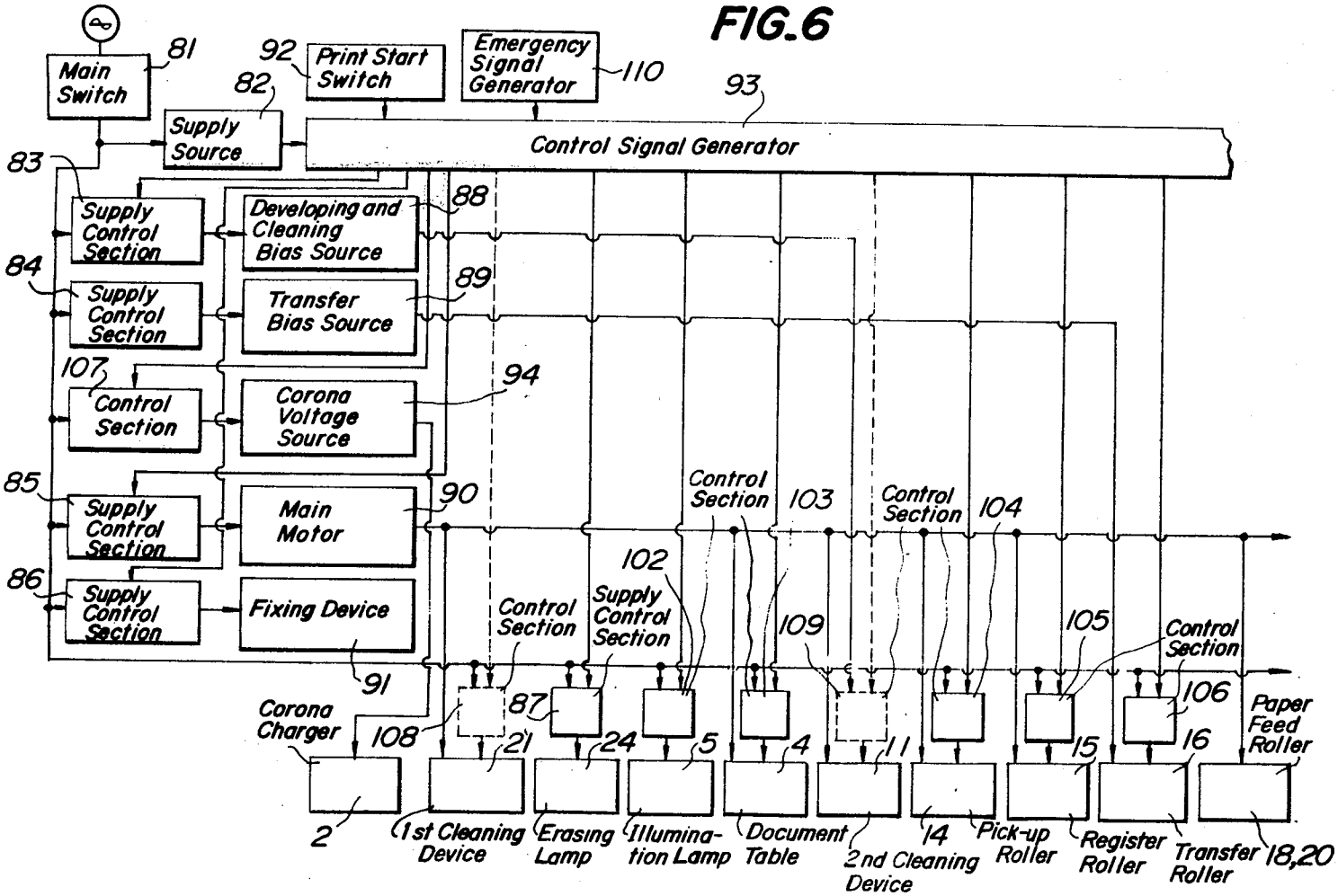
FIG.6
Main Switch
81
Supply Source
82
Print Start Switch
92
Emergency Signal Generator
110
Control Signal Generator
93
Supply Control Section
83
Supply Control Section
84
Control Section
107
Supply Control Section
85
Supply Control Section
86
Developing and Cleaning Bias Source
88
Transfer Bias Source
89
Corona Voltage Source
94
Main Motor
90
Fixing Device
91
Control Section
103
Control Section
104
Control Section
105
Control Section
106
Supply Control Section
102
Control Section
87
Control Section
109
Corona Charger
108
1st Cleaning Device
21
Erasing Lamp
24
Illumination Lamp
5
Document Table
4
2nd Cleaning Device
11
Pick-up Roller
14
Register Roller
15
Transfer Roller
16
Paper Feed Roller
18,20
2

TONER CLEANING APPARATUS

BACKGROUND OF THE INVENTION

The present invention relates to a toner cleaning apparatus for use in an electrophotographic apparatus which comprises an electrostatic charge retentive member movably arranged in a given direction, means for forming an electrostatic charge latent image corresponding to an image of a document to be duplicated, means for developing the latent image with a dry toner to form a toner image and means for transferring the toner image onto a record paper, said latent image forming means, developing means and transferring means being arranged in this order viewed in the moving direction of the charge retentive member.

In the electrophotographic apparatus of the kind mentioned above, residual toner on the charge retentive member has to be removed or cleaned after the transferring operation. Two cleaning methods have been known and practiced. In one method use is made of an exclusive cleaning device and in the other method the developing device for effecting the toner development is utilized also for cleaning the residual toner. In the first method it is possible to effect the cleaning step independently from the developing step and thus the whole duplicating steps can be carried out in a very efficient manner, but the removed toner could not be used again for the development and thus is wasted. In order to avoid such a drawback it is necessary to provide a very complicated and large mechanism for transporting the removed toner at the cleaning section to the toner developing device. Whereas in the second method the removed toner naturally enters into the developing device and is used again for development, but in this case the toner developing step and cleaning step could not be effected independently from each other and thus the whole duplicating steps might be inefficient.

The exclusive cleaning device may be constructed in various forms, but all of them have a serious drawback that maintenance is very cumbersome. In U.S. Pat. Nos. 2,832,977 and 2,911,330 the cleaning device is formed as a cleaning brush which is rotated at a high speed with being in contact with the charge retentive member so as to brush the residual toner off the charge retentive member. The removed toner particles are collected by a filter with the aid of a vacuum suction device. Such a cleaning device has a disadvantage that during the long time operation the cleaning brush might be deformed to decrease a cleaning efficiency and the filter might be filled with toner particles to decrease a toner collection efficiency. Therefore the toner particles brushed off the retentive member might scatter and float inside the apparatus. A web type cleaning device is also known in which an elongated web is pressed against the charge retentive member by a resilient roller to wipe the residual toner off the retentive member. The web is installed in the apparatus as a roll and is gradually taken-up by a roller. But since the web has a finite length the web roll must be exchanged. Further, since the web is resiliently urged against the charge retentive member the surface of member is liable to be injured. There has been further known a blade type cleaning device in which a blade made of resilient material such as rubber is urged against the charge retentive member so as to wipe the residual toner off the member. In such a device the blade is liable to wear relatively soon and should be exchanged frequently. In the U.S. Pat. No. 2,911,330 there is described a cleaning device which utilizes a magnetic force. For instance, in case of using a two component developer such as a combination of magnetic carriers and toner particles or beads and toner particles, the carriers of magnetic particles or beads serve to attract the residual toner on the charge retentive member by means of a magnet roller or bucket conveyor. During the cleaning operation a bias voltage may be applied or a separate discharging member may be provided in order to improve the cleaning effeiciency. However in such a device the carriers have to be exchanged periodically, because the toner retaining ability of carriers decreases owing to toner particles adhered to the carriers.

As explained above various types of the exclusive cleaning devices have been developed, but have a common drawback that the periodic maintenance is required. That is to say every several to ten thousand copies cleaning brush, web, blade or filter should be exchanged.

SUMMARY OF THE INVENTION

The present invention has for its object to provide a toner cleaning apparatus which can avoid the above mentioned drawbacks of the known apparatus and can be used for a quite long time without maintenance with a minimum amount of wasted toner.

It is another object of the invention to provide a toner cleaning apparatus which is very suitable for effecting the duplicating operation in a very efficient manner.

It is still another object of the invention to provide a toner cleaning apparatus which can be advantageously used in a multiple duplicating apparatus in which a plurality of copies of a single document are formed from the same and single electrostatic charge image once formed on a charge retentive member.

According to the invention a toner cleaning apparatus for use in an electrophotographic apparatus which comprises an electrostatic charge retentive member movably arranged in a given direction, means for forming an electrostatic latent image corresponding to an image of a document to be duplicated; means for developing the latent image with dry toner to form a toner image and means for transferring the toner image onto a record paper, said latent image forming means, developing means and transferring means being arranged in this order viewed in the moving direction of the charge retentive member, comprising a first exclusive cleaning device arranged between the transferring means and the latent image forming means;

means for operating said developing means as a second cleaning means; and control means for selectively operating said first and second cleaning devices in accordance with a duplicating operation of the electrophotographic apparatus.

In a preferred embodiment of a toner cleaning apparatus according to the invention said control means is so constructed that the second cleaning device is usually made operative and only when the removal of residual toner by the second cleaning device is too late to form a latent image, the first exclusive cleaning device is made operative.

Figure 3:
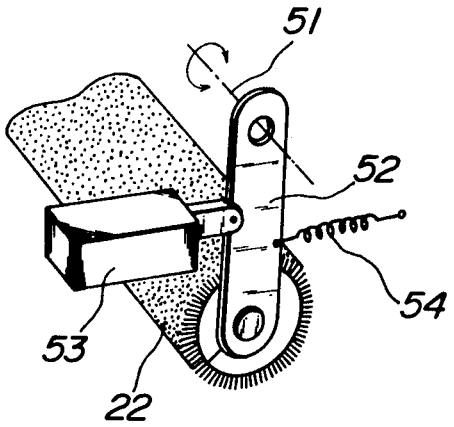
Figure 4:
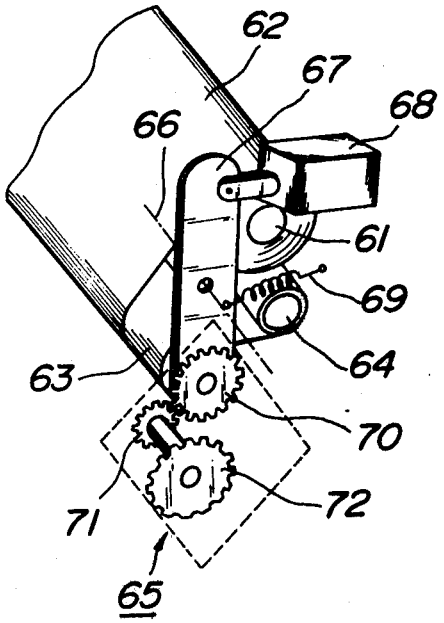
Figure 5:
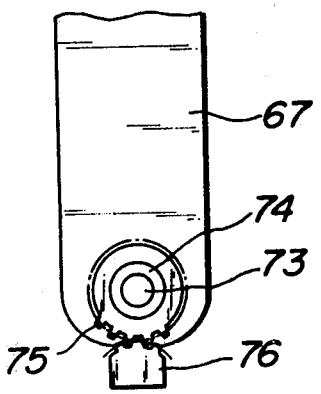
Figure 7:
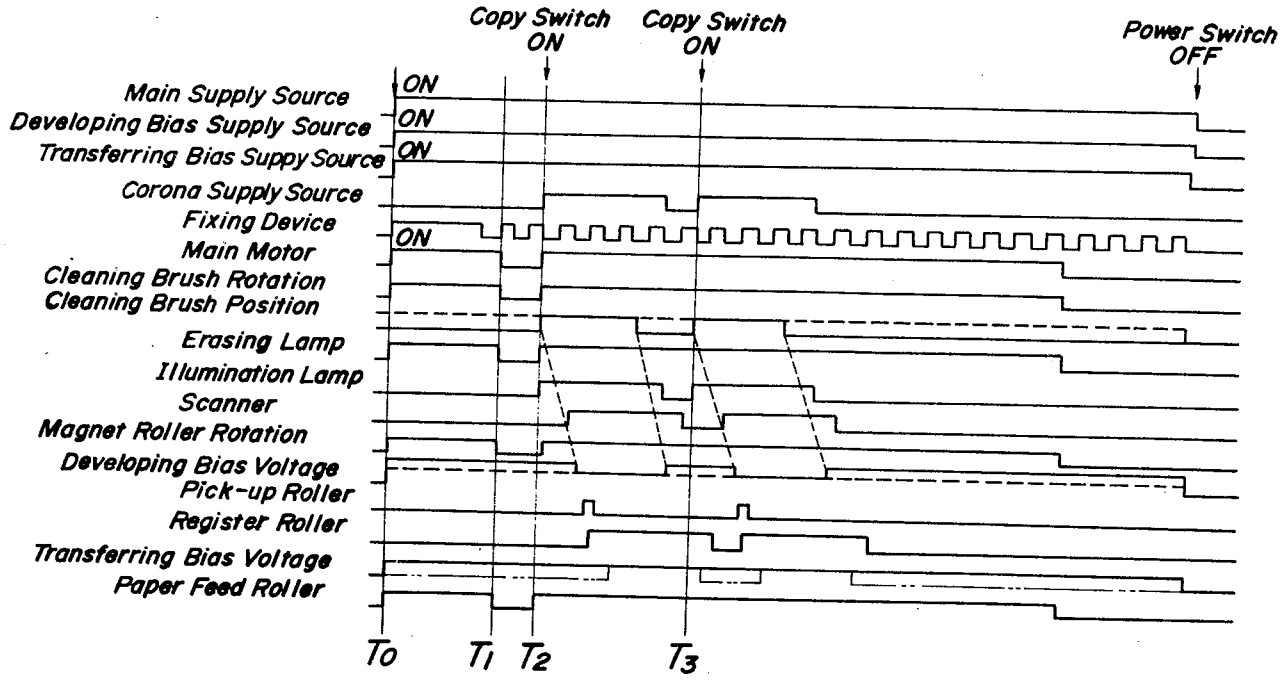
Figure 8:
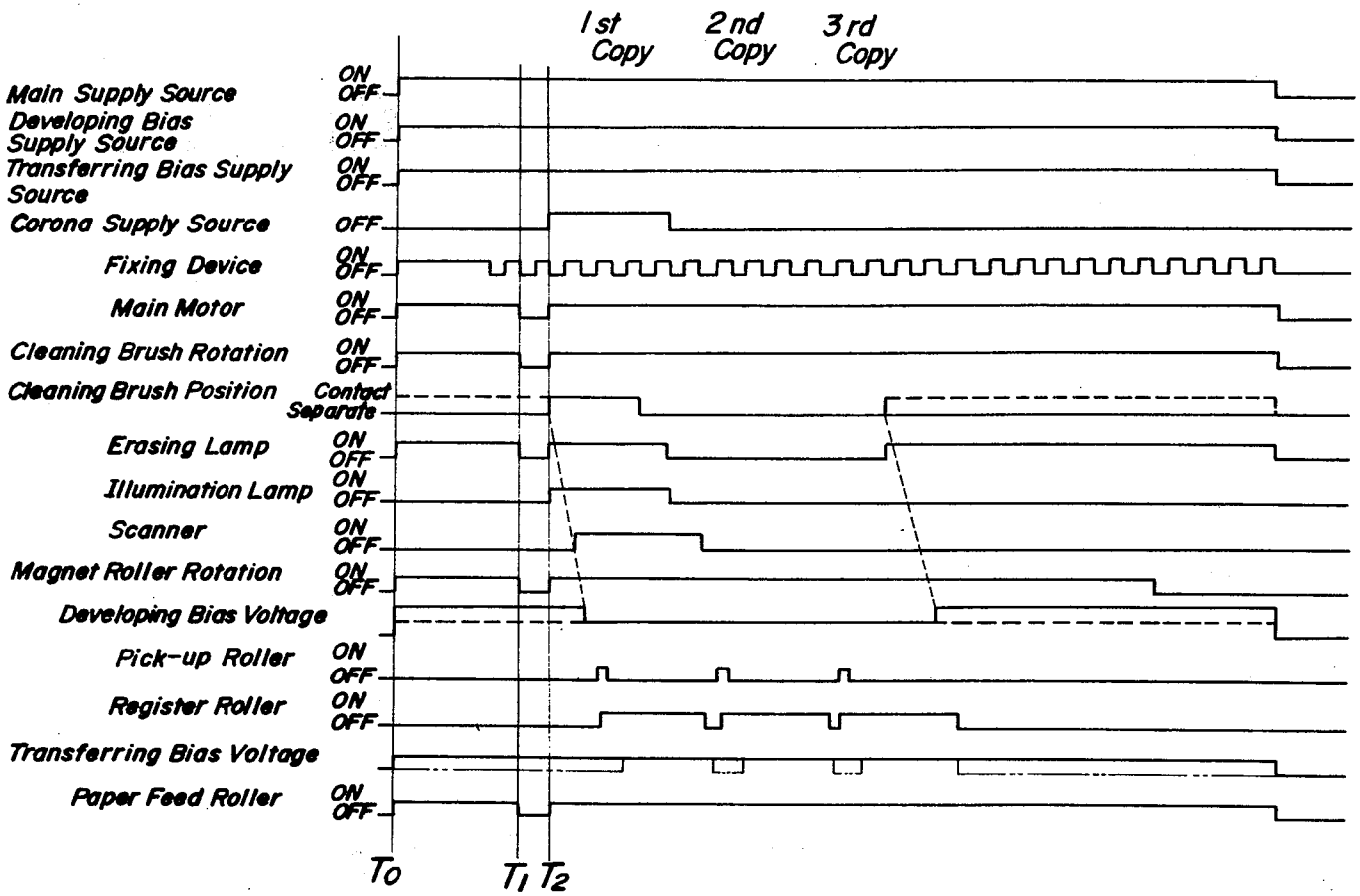

FIGS. *2a, 2b* and *2c* are schematic views illustrating three embodiments of a mechanism for changing a bias voltage applied to a developing and cleaning device;

FIG. 3 is a perspective view depicting a mechanism for selectively urging a cleaning brush against a photosensitive drum;

FIG. 4 is a perspective view showing an embodiment of a mechanism for selectively bringing a web into contact with the photosensitive drum;

FIG. 5 is a front view illustrating a mechanism for feeding the web;

FIG. 6 is a schematic block diagram showing an embodiment of a control system of the copying apparatus to which the cleaning apparatus according to the invention is applied;

FIG. 7 is a timing chart for explaining the operation of the various portions of FIG. 6; and FIG. 8 is a timing chart for controlling the operation of the multiple copying electrophotographic apparatus in which a plurality of copies are obtained from the same and single latent image.

DESCRIPTION OF THE PREFERRED EMBODIMENTS

Figure 1:
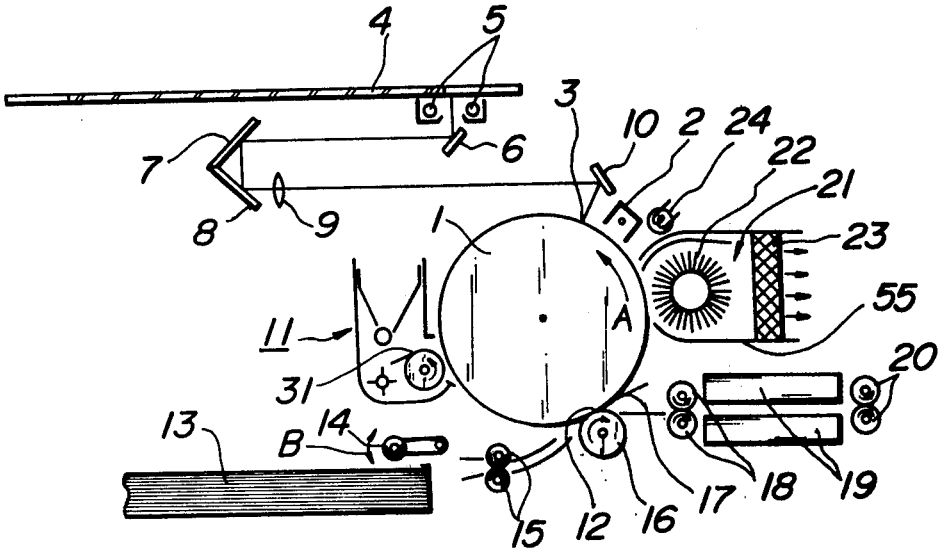
FIG. 1 is a schematic view showing an embodiment of an electrophotographic apparatus to which a cleaning apparatus according to the invention is applied.

FIG. 1 is a schematic view showing an embodiment of an electrophotographic apparatus comprising a toner cleaning device according to the invention. The construction and operation of the apparatus will be explained.

The apparatus comprises a photosensitive drum 1 including a conductive drum substrate made of aluminium and a photosensitive layer made of Se, Se alloy, organic photosensitive semiconductor, a composite organic and inorganic photosensitive semiconductor, a double layer of inorganic photosensitive semiconductor and light permeable insulator. The drum 1 is rotated in a direction shown by an arrow A and is uniformly charged by a corona charger 2. The charged surface of drum 1 is subjected to an imagewise exposure at an image projection section 3. For this purpose a document placed on a transparent document table 4 is illuminated by a lamp 5 and a light reflected from the document is projected onto the drum 1 by means of reflecting mirrors 6, 7, 8 and 10 and a projection lens 9. The image projected on the drum 1 at the section 3 is linewise or strip-wise, but by moving the document table 4 or the lamp 5, mirrors 6, 7 and 8 and lens 9 in synchronism with the rotational movement of drum 1 it is possible to form on the drum 1 an electrostatic charge latent image corresponding to the whole document image. The latent image is developed with a toner by a developing device 11 to form a toned image. In the present embodiment use is made of a magnet roller type developing device together with a two component developing agent consisting of magnetic carriers and toner particles. Any other type of developing device may also be used. For instance, a developing device comprising a biased resilient roller or a well known cascade developing device may be used. Further use may be made of a single component developing agent including toner particles having an electrostatic attractive force due to a frictional electrification.

According to the invention the developing device 11 is also used as a toner cleaning device and comprises a special construction which will be explained later. Thus the device 11 will be sometimes referred to as a cleaning device or a developing and cleaning device.

The developed toner image is transferred at a transfer section 12 onto a record paper which is fed from a paper cassette 13 in synchronism with the rotation of photosensitive drum 1. The record papers are stuck in the cassette 13 and are fed one by one by a rotating pick-up roller 14 journaled to a member swinging up and down as shown in a double arrow B. The feed timing of the record paper is corrected by register rollers 15 in such a manner that the toner image is registered with respect to the record paper at the transfer section 12. At the transfer section is rotatably arranged a transfer roller 16 which presses the record paper against the drum 1 under a relatively small pressure. With the aid of this pressure and the transfer bias voltage the toner image on the drum 1 is transferred onto the record paper. The record paper having the toner image transferred thereto is peeled off the drum 1 by means of a peeling claw 17 and an air stream (not shown). Then the record paper is fed by feed rollers 18 into a fixing device 19 in which the toner image is fixed on the record paper. The final copy having the toner image fixed thereto is discharged from the apparatus.

On the surface of photosensitive drum 1 are remained toner particles even after the toned image has been transferred at the transfer section 12. These residual toner particles should be removed or cleaned before a formation of a latent image of another document to be duplicated next. According to the invention a first exclusive cleaning device 21 and a second cleaning device which is constituted by the developing device 11 are selectively used to effect the cleaning operation. In this embodiment the first cleaning device 21 is formed by a brush type cleaning device comprising a rotating brush 22, a filter 23 and a vacuum suction device (not shown). It should be noted that any other type of cleaning device such as a web type and a blade type may also be used as the first exclusive cleaning device.

According to the invention the first and second cleaning devices 21 and 11 are selectively used in response to the duplicating steps. The first cleaning device 21 has an advantage that it is preferable to improve the duplication efficiency, but has a drawback that the maintenance thereof is cumbersome. While the second cleaning device 11 has an advantage that its maintenance is easy, but has a disadvantage that the duplication efficiency is lowered. Since the problem of the maintenance has been explained in detail, the duplication efficiency will be described hereinafter. Since the first cleaning device 21 is arranged between the transfer section 12 and the exposure section 3, when a portion or area on the drum 1 which has been subjected to the imagewise exposure at the section 3 returns to this section 3 after one revolution of the drum 1, this area can be subjected to a new imagewise exposure. In this manner a very efficient duplication can be carried out. For instance, in case of forming a plurality of copies from the same and single document or forming a single copy of each of documents successively supplied by a document feed device it is possible to shorten a time interval between successive imagewise exposure steps and thus the first exclusive cleaning device 21 is advantageously used. However, as explained above the exclusive cleaning device 21 has the problems about the maintenance, waste of toner, etc. These problems can be solved by using the second cleaning device consisting of the developing device 11. However in this case the drum could not be cleaned even though the drum 1 has rotated over one turn after the imagewise exposure and thus a next imagewise exposure could not be effected at this time. In order to clean the drum 1 it has to be rotated further through the second cleaning device 11. Therefore the next imagewise exposure should be started after the drum 1 has been completely cleaned or at least the portion of drum 1 which has the residual toner has passed through the exposure section 3. In this manner when the second cleaning device 11 is solely used, the efficiency of the duplicating operation becomes decreased as compared with a case in which the exclusive cleaning device 21 is solely used. Particularly if an area of drum 1 on which the charge image can be formed is limited or restricted owing to a seam of the drum 1, a new imagewise exposure can not be started unless the area returns to the section 3 through the second cleaning device 11. Therefore in order to form a single copy the photosensitive drum 1 has to be rotated by two turns and thus the duplicating efficiency becomes much lower. Even in case of a seamless drum the drum should be rotated additionally more than one turn as explained above.

The inventor has found that the additional rotation of the drum does not substantially affect the duplication efficiency depending upon duplication mode. That is to say, if a marginal time is existent between the completion of a first duplication and a next duplication, the additional rotation of the photosensitive drum 1 can be allowed without lowering the duplication efficiency. In a usual electrophotographic apparatus the document to be duplicated is placed on the document table 4 and a document cover made of a relatively thick rubber sheet is placed over the document. Then the document table or the optical system 5, 6 . . . is moved to scan the document. After the scanning has been completed and the table 4 or the optical system has returned to the initial position, the document cover is opened and the document is removed. Then another document to be copied next is placed on the table and the cover is closed and then the exposure is started. Usually there is a relatively long time to set the next document and thus during this long time the residual toner on the drum has passed through the developing device, i.e. the second cleaning device. In this case the drawback of the second cleaning device 11 does not appear and thus it is reasonable or preferable to use the second cleaning device 11 for removing the residual toner.

In order to selectively use either one of the first and second cleaning devices 21 and 11 it is necessary to provide a mechanism for making the first cleaning device 21 operative or inoperative and a mechanism for switching the device 11 between the developing device and the cleaning device. Such mechanisms will be explained hereinbelow.

Figure 2A:
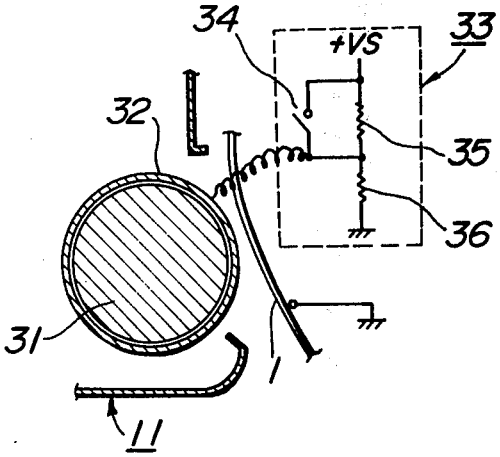

FIG. 2*a* is a schematic view illustrating the developing and cleaning device 11. FIG. 2*a* shows a part of a magnet roller 31 of the device 11 is an enlarged scale. Around the roller 31 is arranged a developing sleeve 32 made of electrically conductive and non-magnetic material, to which is applied a bias voltage from a bias voltage supply source 33. By actuating a switch 34 in the supply source 33 the device 11 can be selectively operated as the cleaning device and the developing device. When the switch 34 is opened, a relatively lower bias voltage divided by resistors 35 and 36 is applied to the sleeve 32 and thus the device 11 operates as the developing device. When the switch 34 is closed, a higher bias voltage is applied to the sleeve 32 and then the device 11 works as the cleaning device.

Figure 2B:
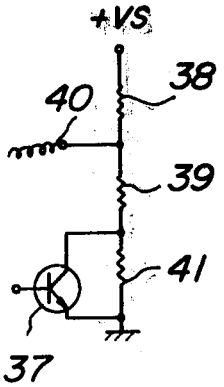
Figure 2C:
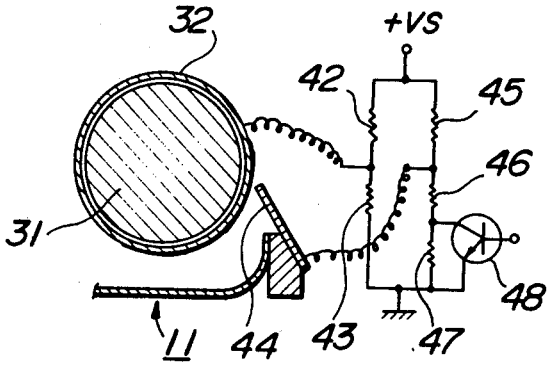

FIG. 2*b* shows another embodiment of the bias voltage supply circuit. In this embodiment when a control signal is applied to a transistor 37 to conduct, a relatively lower bias voltage divided by resistors 38 and 39 appears at an output 40, while when the transistor 37 is blocked, a relatively higher bias voltage divided by the resistor 38 and the resistors 39 and 41. In this manner when the transistor 37 is made conductive, a bias voltage suitable for operating the device 11 as the developing device is applied to the sleeve 32, whilst when the transistor 37 is made off, a bias voltage suitable for operating the device 11 as the cleaning device is applied to the sleeve. In this embodiment since a breakdown voltage of the collector-emitter of transistor 37 is sufficient to control a difference in the developing bias voltage and the cleaning bias voltage, it is easy to select the transistor 37 as compared with the case in which the cleaning bias voltage is directly controlled. In the embodiment shown in FIG. 2*c* a constant bias voltage divided by resistors 42 and 43 is applied to the sleeve 32 and a doctor blade is used as an electrode to which is applied a variable bias voltage. This variable bias voltage is derived from a circuit including resistors 45, 46 and 47 and a transistor 48 which are connected in a similar manner as shown in FIG. 2*b*. In this embodiment illustrated in FIG. 2*c* the sleeve 32 may be connected to the earth potential or a floating potential.

The device 11 may be selectively operated as the developing device and the cleaning device without changing the bias voltage. For instance, after the transferring step the photosensitive drum 1 is irradiated by a discharging lamp 24 in FIG. 1 so as to erase substantially the latent image. Then the attractive force applied to the residual toner on the drum is weakened to a great extent. Under such a condition when the residual toner is passed through the device 11 which is so biased as to operate as the developing device, the residual toner particles are attracted to the developer in the device 11. In this manner the cleaning operation can be effected. Therefore the changing the developing device into the cleaning device by switching the bias voltage may be adopted in such cases that the erasing lamp 24 is not provided or the concentration of residual toner is too high to erase sufficiently the latent image on the drum by means of the erasing lamp. In the above embodiment the developing device is of the magnet roller type developing device with the two component developing agent consisting of a mixture of iron powder carriers and toner particles. However any other type of developing device may be utilized as the cleaning device by controlling the bias voltage. For example, use may be made of the cascade developing device comprising a developing electrode plate, a developing device with a single component magnetic toner, or a developing device comprising a biased conductive roller holding a single component non-magnetic toner.

Next means for switching the first cleaning device 21 between an operative state and an inoperative state will be explained. FIG. 3 shows a supporting mechanism for the cleaning brush 22 of the cleaning device 21. In usual electrophotographic apparatus the cleaning brush 22 is provided to be brought always into contact with the photosensitive drum. But according to the invention the cleaning brush 22 is removably arranged with respect to the photosensitive drum 1. For this purpose the cleaning brush 22 is journaled at its one end to an arm 52 which is rotatable about an axis 51. A plunger of a solenoid 53 is connected to the arm 52 to which is also coupled a coiled spring 54. It should be noted that the other end of the brush 22 is also journaled to a rotating arm to which a motor for rotating the brush at a high speed is secured. While the solenoid 53 is not energized, the arm 52 rotates in the anti-clockwise direction by means of the spring 54 and thus the brush 22 is separated from the drum 1. On the contrary when the solenoid 53 is energized, the arm 52 rotates in the clockwise direction against the force of the spring 54 and the brush 22 is made into contact with the drum 1. As illustrated in FIG. 1 the brush 22 is installed in a suction box 55 and the residual toner removed from the drum 1 is collected by the filter 23.

FIG. 4 is a perspective view showing another embodiment of the first exclusive cleaning device. This cleaning device comprises a web supply shaft 61, a resilient pressure roller 63 for urging a web 62 against the photosensitive drum, a web take-up shaft 64 and a driving device 65 for taking-up the web 62 at a very low rate. In usual web type cleaning devices the web is always urged against the photosensitive drum by means of the pressure roller. On the contrary according to the invention the web 62 has to be selectively brought into contact with the drum 1 by means of a control signal. To this end the pressure roller 63 is journaled to an arm 67 which is rotatable about an axis 66. To the arm 67 are connected a plunger of a solenoid 68 and a coiled spring 69. Only when the solenoid 68 is energized, the web 62 is urged against the drum 1. In order to feed the web 62 at a very small rate the device 65 includes gears 70, 71 and 72 and the gear 72 is always rotated by a motor at a very low speed. The gear 70 is selectively brought into engagement with the gear 71 when the arm 67 is rotated in the clockwise direction by the solenoid 68. Therefore the web 62 is taken-up on the take-up shaft 64 at the very small rate when the web 62 is urged against the drum, but the feeding of the web is stopped when the web 62 is separated from the drum. Therefore the web 62 is not wasted and thus is not necessary to be exchanged frequently.

FIG. 5 shows another embodiment of the mechanism for taking-up the web 62. In this embodiment each time the arm 67 swings the pressure roller 63 is rotated by a very small angle. A gear 75 is coupled to a shaft 73 of the pressure roller 63 through an one-way clutch 74 which engages with a stational gear 76. When the arm 67 swings, the gear 75 rotates in both directions by a small angle, but the roller 63 is rotated in the one direction by a very small angle due to the presence of the one-way clutch 74. The mechanisms for feeding the web only when the cleaning operation is effected may be constructed in various ways other than those explained above. For instance, the motor for rotating the pressure roller 63 may be energized in synchronism with the solenoid 68. Further any type of cleaning device other than the cleaning brush and the cleaning web types may be selectively driven into the operative state and the inoperative state. For example, in a blade type cleaning device a blade may be removably or displaceably arranged with respect to the photosensitive drum. In a magnet roller type cleaning device a magnet roller may be displaceably arranged with respect to the drum, a bias voltage applied to the magnet roller may be changed or a position of a doctor blade for setting a thickness of a carrier layer adhered to the magnet roller may be displaced. According to the invention in any kind of cleaning device the weariness and maintenance can be improved by making it selectively inoperative.

Now a method for controlling selectively the first and second cleaning devices will be explained in detail.

FIG. 6 is a flow chart for illustrating a control for major portions of the electrophotographic apparatus shown in FIG. 1. When a main switch or power switch 81 is made on, a voltage supply source for a control circuit 82 is energized and at the same time a bias voltage source 88 for the developing and cleaning device 11, a bias voltage source 89 for the transfer roller 12, a main motor 90 for driving various elements, a fixing device 91 and the charge erasing lamp 24 are energized by means of power supply control sections 83, 84, 85 86 and 87, respectively. Under such a condition when a print start switch 92 is actuated, a control signal generator 93 initiates. The control signal generator may be formed by a sequential control disc rotating in synchronism with the photosensitive drum 1, or a combination of a clock pulse generator for producing clock pulses synchronized with the rotation of the drum 1 and a plurality of preset counters for counting the clock pulses. The control signal generator produces timing pulses serving as reference signals for operations of various portions. These timing pulses are supplied to the illumination lamp 5, the document scanning mechanism, e.g. the document table 4, the pick-up roller 14, the register rollers 15, the transfer roller 16 and a voltage supply source 94 for the corona charger 2 by means of control sections 102, 103, 104, 105, 106 and 107, respectively at given timings. In order to control the first and second cleaning devices 21 and 11 control sections 108 and 109 denoted by dotted lines are provided. It should be noted that the cleaning brush 22, magnet roller 31 and paper feed rollers 18 and 20 are always rotated as long as the main motor 90 is energized. Further, the pick-up roller 14, register rollers 15 and document table 4 are driven by the main motor 90 through clutches which are included in related control sections 104, 105 and 103. Upon a paper jam the transfer roller 16 can be separated from the photosensitive drum 1 by a solenoid. The remaining controls are effected by applying or changing the voltages. Therefore the control sections 102 and 109 may be constructed by relays, solenoids, electromagnetic clutches, and semiconductor elements.

To the control signal generator 93 is connected an emergency signal generator 110 which produces an emergency signal upon the detection of emergent status such as the paper jam so as to alter the timing signals in accordance with particular status.

FIG. 7 is a timing chart showing the control timings of various portions illustrated in FIG. 6. At a timing $T_0$ the main switch 81 is made on. The supply source 82 for the control circuit, developing bias voltage supply source 88, the transfer bias voltage supply source 89 and the fixing device 91 are all energized as long as the main switch 81 is made on. The fixing device 91 is automatically controlled to a given temperature and in practice its power supply is periodically switched on and off. The rotations of the cleaning brush 22, magnet roller 31 and paper feed rollers 18 and 20 are controlled by a timer (not shown) and are stopped at a timing $T_1$ after the actuation of the main switch 81 so as to avoid that the electric power might be wasted. When the print start switch 92 is made on, the timer is set to the initial state and thus the main motor 90, the erasing lamp 24, etc. are made operative for a given time period after the actuation of the switch 92. When the print start switch 92 is operated at a timing $T_2$, the timing pulses from the control signal generator 93 serve to operate the corona charger 2, document table 4, illumination lamp 5, pick-up roller 14 and register rollers 15 at timings shown in FIG. 7.

According to the invention the bias voltage to the developing and cleaning device 11 and the displacement of the cleaning brush 22 with respect to the drum 1 are controlled. Usually the cleaning brush 22 is separated from the drum 1 and each time the print start switch 92 is actuated, the brush 22 is made into contact with the drum 1 for a given time to clean a portion of the drum which portion is to be subjected to the document image exposure. The bias voltage to the developing and cleaning device 11 is usually high enough to operate the device as the cleaning device and only when the portion of the drum on which the latent image has been formed passes through the device 11, the device 11 is driven to operate as the developing device. Therefore when the print start switch 92 is made on at the timing $T_2$, the photosensitive drum 1 has been cleaned by the second cleaning device 11 and thus even if the cleaning brush 22 is made in contact with the drum 1 no residual toner is removed by the first cleaning device 21. In this manner the clog of the filter 23 and waste of toner can be avoided. This can be similarly applied to a case in which a sufficiently long time interval can be obtained between successive actuations of the print start switch 92.

It should be noted that when a next printing step is initiated immediately after the start of the first printing operation as shown by a timing $T_3$ in FIG. 7, the residual toner is cleaned by the first cleaning device 21. The portion of the drum 1 which has been cleaned by the first cleaning device 21 is subjected to the uniform electrification and the imagewise exposure so that a latent image of the next document is formed. This latent image has to be developed by the device 11. For this purpose when the portion of the drum 1 which has been cleaned by the first cleaning device 21 comes under the device 11, the bias voltage applied to this device 11 should be changed to a low value. In an actual apparatus a portion of the drum 1 which is subjected to the developing operation is preferably wider than that portion of the drum which is subjected to the imagewise exposure and the first cleaning device 21 can preferably clean whole width of the drum 1. The timing at which the first cleaning device 21 operates deviates from that at which the device 11 acts as the second cleaning device as shown by inclined broken-lines in FIG. 7.

As explained above the cleaning brush 22 of the first cleaning device 21 is always separated from the photosensitive drum 1 except when it cleans the portion of drum on which the latent image is to be formed after the actuation of the print start switch 92 and thus the brush 22 is hardly worn. Further the developing and cleaning device 11 operates usually as the cleaning device except when the latent image passes through the device 11 and thus the residual toner is effectively cleaned by the second cleaning device 11 without loss of toner. Further an amount of toner to be removed by the first cleaning device 21 is very small and thus an amount of toner to be wasted is also very small.

In the embodiment shown in FIG. 7 every time the print start switch 92 is made on, the first cleaning device 21 is made operative and the cleaning brush 22 is made in contact with the photosensitive drum 1. Thus even when a time interval between successive actuations of print start switch 92 is sufficiently long and thus the cleaning operation has been completed by the second cleaning device 11, the cleaning brush 22 of first cleaning device 21 is brought into contact with the drum 1. This results in worthless wear of the brush 22. In a preferred embodiment there is provided a second timer which is initiated every time the print start switch 92 is operated. This second timer is remained operative until the residual toner of the duplicating operation which has been started together with the second timer has been removed by the second cleaning device 11. During the operation period of the second timer when the print start switch 92 is actuated again, the cleaning brush 22 is made in contact with the drum 1. According to such a construction the cleaning brush 22 of first cleaning device 21 is urged against the photosensitive drum 1 for a shorter time period and thus the wear of the cleaning brush 22 can be further reduced. For the sake of simplicity the operation time of the second timer is set as explained above, but in practice, this operation time may be further shortened. That is to say the operation time of the second timer may be set in such a manner that the first cleaning device 21 is not necessary to become operative after the operation time of the second timer has been expired.

In the above explanation a single copy is formed by a single imagewise exposure. In such an electrophotographic apparatus, when it is required to print a plurality of copies of the same and single document, the document remains on the document table 4 and the exposure is successively effected. Therefore there is not long time interval between successive imagewise exposure steps and thus the cleaning should be effected by the first cleaning device 21. In this manner, in the case of forming a plurality of copies from the single document, the first cleaning device 21 is frequently made operative and thus the effect of the present invention could not be sufficiently attained. There is another type of electrophotographic apparatus in which a plurality of copies are obtained by repeatedly using the same and single latent image once formed on a photosensitive drum. In such a multiple copying apparatus it is not necessary to remove the residual toner during the multiple duplication, but it is rather preferable not to effect the cleaning operation in order to minimize the deterioration of the latent image. Therefore in such an apparatus the first cleaning device 21 can be inoperative during the multiple duplication and the wear of the cleaning device and loss of toner can be avoided very effectively.

FIG. 8 is a timing chart showing an operation of the multiple copying apparatus to which the cleaning apparatus according to the invention is applied. In this embodiment three copies are formed from the same latent image. The steps for forming the latent image and a first copy after the actuation of the main switch 81 and steps after the formation of a third copy are same as those shown in FIG. 7. However during the formation of multiple copies the high tension corona supply source 94 is deenergized and thus the corona charger 2 is made inoperative. The cleaning brush 22 is kept separated from the drum 1 and the bias voltage to the device 11 is made low and thus the device 11 operates as the developing device. Further the erasing lamp 24 and illumination lamp 5 are made off and the document table 4 is made stationary.

In the embodiments shown in FIGS. 7 and 8 the bias voltage applied to the device 11 is changed to selectively operate the device as the developing device and cleaning device, but if the erasing function of the erasing lamp 24 is sufficiently strong, the switching of the bias voltage may be omitted. On a column of developing bias voltage in FIGS. 7 and 8 such an embodiment in which the bias voltage is not changed is illustrated by broken lines. Further on a column indicating the position of the cleaning brush 22 in FIGS. 7 and 8 there is shown a conventional apparatus in which the cleaning brush 22 is always made in contact with the photosensitive drum 1 and the device 11 is always operated solely as the developing device. Moreover the transfer bias voltage may be applied to the transfer roller 16 only when the toner image passes through the transfer section 12 as shown by chain lines in FIGS. 7 and 8.

As explained above according to the invention an exclusive cleaning device is arranged at such a position that it can clean an area of a photosensitive drum on which a latent image is formed even after the initiation of the duplicating operation and usually a developing and cleaning device is operated as a second cleaning device. Only when the second cleaning device could not be used to clean the drum, the first exclusive cleaning device is made operative. Therefore a portion of drum which has been cleaned by the first cleaning device may be cleaned again by the second cleaning device or vise versa. A part of residual toner may be cleaned by the first cleaning device and the remaining toner may be removed by the second cleaning device. In such a case, areas to be cleaned by the first and second cleaning devices are partially overlapped with each other so as to remove effectively the residual toner. The cleaning apparatus according to the invention may be applied to any kind of electrophotographic apparatus. For instance, a photosensitive belt may be used instead of the photosensitive drum or a charge retentive member may be provided separately from a photosensitive member. Further the document scanning mechanism is not limited to the movable document table and the movable optical system, but the document may be fed by rollers with respect to a stationary optical system.

According to the invention since the wear and deterioration of the cleaning device can be reduced the maintenance becomes easy and further an amount of the wasted toner can be minimized.

What is claimed is:

1. A toner cleaning apparatus for use in an electrophotographic apparatus which comprises an electrostatic charge retentive drum rotatably arranged in a given direction, means for forming an electrostatic latent image corresponding to an image of a document to be duplicated, means for treating dry toners to develop the latent image with the dry toners to form a toner image on the drum, and means for transferring the toner image onto a record paper which is fed with being in contact with the drum, said latent image forming means, toner treating means and transferring means being arranged in this order viewed in the rotating direction of the drum, comprising a first exclusive cleaning device arranged between the transferring means and the latent image forming means viewed in said rotating direction of the drum and being driven into an operative position in which the first exclusive cleaning device is made in contact with the drum and into an inoperative position in which the first exclusive cleaning device is made apart from the drum; first control means for selectively driving said first exclusive cleaning device into either the operative position or the inoperative position; second control means for selectively operating said toner treating means as a developing device or a second cleaning device; and third control means for controlling said first and second control means in such a manner that when a power supply is applied to the electrophotographic apparatus, said toner treating means is made operative as the second cleaning device for at least one revolution of the drum to remove possible residual toners on the drum; that as long as the latent image has to be developed during a duplicating operation, said toner treating means is made operative as the developing device; when a print start signal for initiating the duplicating operation for a next document is not given within a time interval from a time when a front edge of the latent image on the drum passes through a position of the transferring means to a time when the front edge of the latent image arrives at a position of the first exclusive cleaning device, the toner treating means is made operative as the second cleaning device to remove residual toners on the drum during at least one additional revolution of the drum, while the first exclusive cleaning device is driven into said inoperative position; and when said print start signal is given within said time interval, said first exclusive cleaning device is driven into said operative position so as to initiate immediately a formation of a latent image of the next document.

2. A toner cleaning apparatus according to claim 1 for use in a multiple duplicating electrophotographic apparatus in which a plurality of copies of a single document are formed from the same and single latent image once formed on the drum, wherein: said third control means is so constructed that during the multiple duplicating operation said toner treating means is made operative as the developing device until the toner image for forming a last copy of multiple copies is formed on the drum, while said first exclusive cleaning device is remained in said inoperative position, that when said print start signal for duplicating the next document is not given with said time interval, said toner treating means is made operative as the second cleaning device after the toner image for the last copy has been formed, and that when said print start signal is given within said time interval, the first exclusive cleaning device is driven into said operative position so as to initiate immediately the formation of latent image of the next document.

3. A toner cleaning apparatus according to claim 1 wherein: said toner treating means comprises a magnet roll type device including an electrically conductive and non-magnetic sleeve, a magnet assembly arranged inside said sleeve and means for rotating said sleeve and magnet assembly relative to each other, and said second control means comprises a bias voltage source for producing higher and lower bias voltages and a switching device which is connected between the sleeve and the bias voltage source and is driven in such a manner that when the toner treating means is made operative as the second cleaning device, the higher bias voltage is applied to the sleeve and when the toner treating means is made operative as the developing device, the lower bias voltage is applied to the sleeve.

4. A toner cleaning apparatus according to claim 3, wherein said switching device comprises a switch for short-circuiting a part of a voltage divider of the bias voltage source.

5. A toner cleaning apparatus according to claim 3, wherein said switching device comprises a switching transistor for short-circuiting a voltage divider of the bias voltage source.

6. A toner cleaning apparatus according to claim 1, further comprising an erasing lamp which is arranged between the first exclusive cleaning device and the toner treating means viewed in the rotating direction of the drum and is controlled by said third control means in such a manner that when the toner treating means is made operative as the second cleaning device, the erasing lamp is lighted on.

7. A toner cleaning apparatus according to claim 1, wherein: said toner treating means comprises a magnet roll type device including a non-magnetic sleeve, a magnet assembly arranged inside said sleeve and means for rotating said sleeve and magnet assembly relative to each other, and said toner cleaning apparatus further comprising an erasing lamp which is arranged between the first exclusive cleaning device and the toner treating means viewed in the rotating direction of the drum and is controlled by said third control means in such a manner that when the toner treating means is made operative as the second cleaning device, the erasing lamp is lighted on.

8. A toner cleaning apparatus according to claim 1, wherein: said first exclusive cleaning device comprises a rotating cleaning brush journalled to a swingable support member.

9. A toner cleaning apparatus according to claim 1, wherein: said first exclusive cleaning device comprises a cleaning blade secured to a swingable support member.

10. A toner cleaning apparatus according to claim 1, wherein: said first exclusive cleaning device comprises a cleaning web fed around a rotatable pressure roller which is journalled to a swingable support member.

11. A toner cleaning apparatus according to claim 10, wherein: said cleaning web is wound on a supply shaft and is taken-up on a take-up shaft only when the pressure roller is urged against the drum.

* * * * *